US010099818B2

(12) United States Patent
Sprehe

(10) Patent No.: US 10,099,818 B2
(45) Date of Patent: Oct. 16, 2018

(54) RECLOSABLE ZIPPER HAVING CHILD RESISTANT FEATURES

(71) Applicant: Com-Pac International, Inc., Carbondale, IL (US)

(72) Inventor: Gregory S Sprehe, Carbondale, IL (US)

(73) Assignee: Com-Pac International, Inc., Carbondale, IL (US)

( * ) Notice: Subject to any disclaimer, the term of this patent is extended or adjusted under 35 U.S.C. 154(b) by 0 days.

(21) Appl. No.: 14/530,751

(22) Filed: Nov. 1, 2014

(65) Prior Publication Data

US 2016/0122086 A1 May 5, 2016

(51) Int. Cl.
*B65D 33/16* (2006.01)
*B65D 33/00* (2006.01)
*B65D 33/25* (2006.01)

(52) U.S. Cl.
CPC ..... *B65D 33/2508* (2013.01)

(58) Field of Classification Search
CPC ..... B65D 33/2508
USPC ..... 383/65, 61.3, 97
See application file for complete search history.

(56) References Cited

U.S. PATENT DOCUMENTS 5,017,021 A * 5/1991 Simonsen ..... B65D 33/2541 383/63
6,167,597 B1 * 1/2001 Malin ..... B31B 19/90 24/399
6,185,796 B1 * 2/2001 Ausnit ..... B65D 33/2541 24/585.1
7,052,181 B2 * 5/2006 Smith ..... B65D 33/2591 24/400
7,784,160 B2 * 8/2010 Dais ..... B65D 33/2508 24/585.12
7,886,412 B2 * 2/2011 Dais ..... B65D 81/2023 24/399
8,272,107 B2 * 9/2012 Turvey ..... B65D 33/01 24/30.5 R
8,550,715 B2 * 10/2013 Anzini ..... B65D 33/2541 24/399
8,550,716 B2 * 10/2013 Smith ..... B65D 33/255 383/63
2005/0251973 A1 * 11/2005 Sprehe ..... B65D 33/2541 24/399
2006/0230588 A1 * 10/2006 Sprehe ..... A61J 9/001 24/585.12

* cited by examiner

*Primary Examiner* — Derek Battisti
(74) *Attorney, Agent, or Firm* — Sandberg Phoenix & von Gontard P.C.

(57) ABSTRACT

A reclosable child-resistant plastic zipper assembly of indefinite length is disclosed. The assembly has a first zipper strip and a second zipper strip, the zipper strips having complementary reclosure profiles. The zipper assembly lacks upper flanges, but instead terminates at a pair of closure tabs that meet at an opening point when the strips have been mated to provide the closure. The zipper strips each further include a texturized gripping region on the exterior surfaces to enable a user to open the zipper assembly. The assembly may be affixed to the upper end of a bag or other flexible container to provide child-resistant access to the contents therein.

18 Claims, 6 Drawing Sheets

RECLOSABLE ZIPPER HAVING CHILD RESISTANT FEATURES

FIELD OF THE INVENTION

A reclosable zipper is disclosed, the zipper being constructed of plastic and having features aimed at preventing access through the zipper by a child.

BACKGROUND OF THE INVENTION

The statements in this section merely provide background information related to the disclosure and do not necessarily constitute prior art.

Extruded plastic zipper profiles are known in the art, though a need exists for zippers that possess enhanced child resistant features. Ideally such a zipper may be attached to a package having contents unsuitable for children (such as medication or toxic substances, for example) but where a resealable plastic zipper is desirable.

SUMMARY OF THE INVENTION

A new child-resistant reclosable zipper is disclosed, the zipper having no flanges above the zipper opening point or closure tab, and having a pair of textured gripping regions to facilitate the unique opening mechanism of the zipper. The zipper may have a variety of closure profiles, including a plurality of complementary protrusions and grooves. Those protrusions may include hook features that provide a snug closure. Additionally, a hinged zipper feature may be present to enhance the child-resistant nature of the zipper assembly. The zipper may be affixed to a bag or pouch in a variety of manners, including a transverse heat seal or adhesive.

FIGURES

DETAILED DESCRIPTION

The following description of various embodiments is merely exemplary in nature and is in no way intended to limit the invention, its application, or its uses.

A new resealable zipper assembly is disclosed, this zipper having child resistant features. The zipper may include first and second complementary reclosable zipper strips. Each zipper strip includes an interlocking profile, such that the first and second zipper strips may be resealably opened and closed. The zipper may optionally provide an airtight seal along the length of the zipper, such that, when mounted on a package, the package may provide an airtight seal for the contents of the package.

The package onto which the zipper is mounted may be a bag or other flexible pouch or container, and may itself be constructed of one or more ply of plastic films or other suitable materials. In an embodiment, the package is constructed of such a material that a heat seal may be made between the zipper strips and upper edges of the walls of the package. Such a construction may include a plastic bag or a multi-layered bag with an innermost plastic film layer. In another embodiment, the package may be suitable for a hot melt or other adhesive seal between the zipper strips and the upper edges of the walls of the package. Such a construction may include bags constructed of kraft paper or clay coated paper.

The zipper may be extruded through a die from a plastic raw material, including for example polyethylene, polypropylene, polyethylene terepthalate, or other suitable plastics know in the art. The plastic may include additional additive materials such as ethylene acetate, and/or any other suitable additive know in the art, depending on desired performance and/or specifications of the zipper assembly. In some applications, colorants may be added to the plastic.

The zipper extruder apparatus may include a chilling component to cool the extruded plastic to room temperature or some other desirable temperature. Further, the first and second zipper strips may be joined together to form the full zipper assembly as the extrusion process continues, and the zipper may be fed continuously into a spool or cut into certain lengths. The zipper assembly may be of any indefinite length, including a continuous spooled supply of the zipper assembly. The zipper assembly may alternatively be of a fixed length and/or segmented, or may be provided in parallel segments on a continuous film web.

Figure 1:
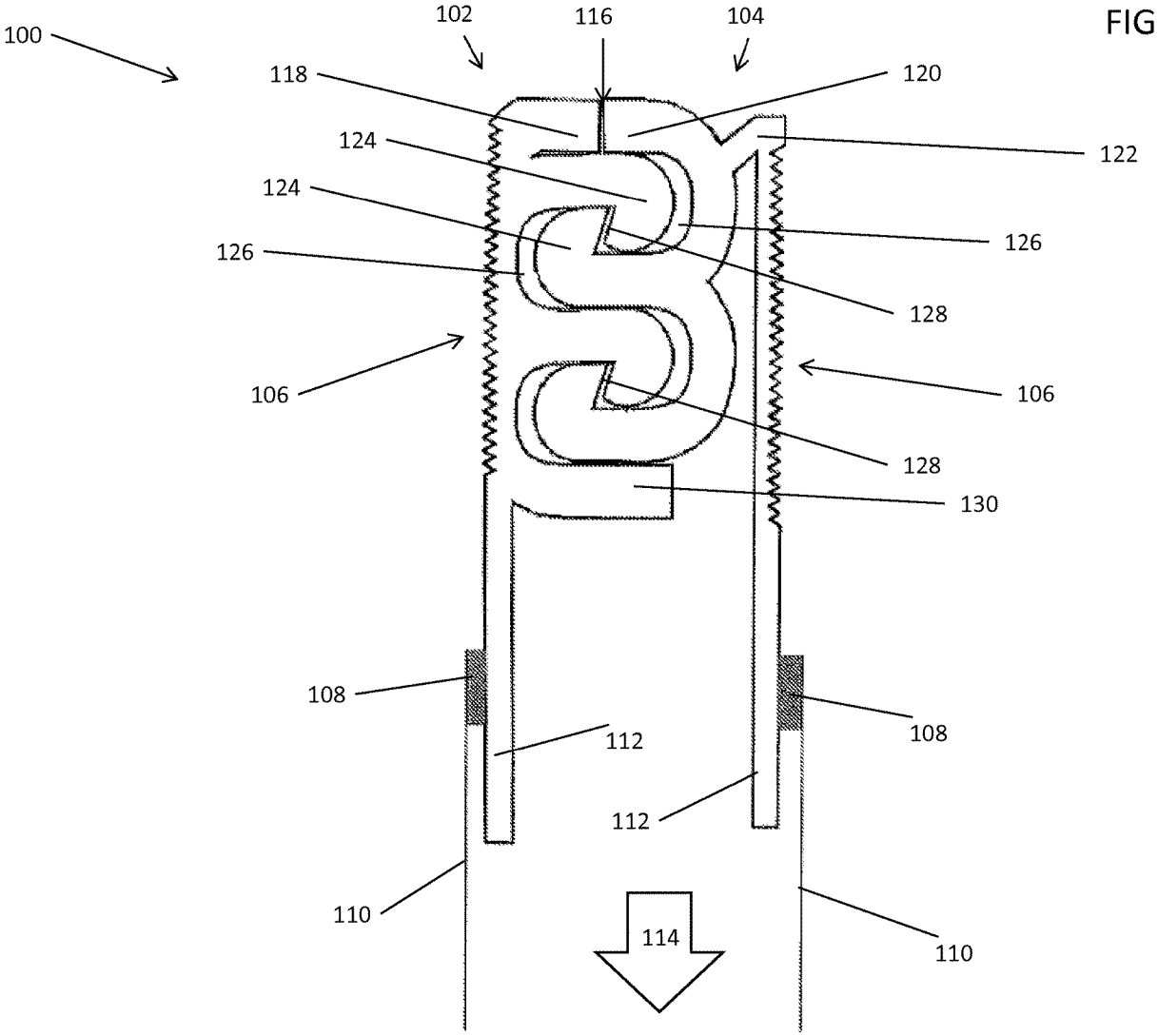
FIG. 1 shows a profile view of a first embodiment of a zipper of the disclosure, this particular zipper having a hinged zipper feature, the zipper having been affixed to a pouch.

Turning to the figures, FIG. 1 shows a cross-sectional view of a resealable zipper assembly 100, the zipper having a first zipper strip 102 and a second zipper strip 104. Each zipper strip includes a knurled or otherwise texturized gripping region 106. The texturized gripping regions may reside on the zipper strips, at or near the reclosure profiles, on the outer sides of the strips. The zipper strips may be adhered or affixed via a heat seal 108 to bag or pouch walls 110 in the upper end of the bag or pouch, the attachment being on lower flanges 112 of each zipper strip. Optionally, the texturized gripping regions of each zipper strip run the length of the zipper assembly. In this way, the zipper assembly provides access through the opened zipper to the inner contents 114 of the bag or pouch. Alternatively, the upper ends of the bag side walls, where the plastic zipper assembly is affixed to the bag, may include a texturized gripping region on the exterior surfaces.

The cross-sectional view of FIG. 1 in particular shows the detail of the interlocking and sealing features of the zipper of this disclosure. The first zipper strip 102 and the second zipper strip 104 meet at an opening point 116, which is defined by the meeting of a first closure tab 118 on the first zipper strip and a second closure tab 120 on the second zipper strip, when the zipper is closed.

The zipper of FIG. 1 includes the optional feature of a zipper hinge 122, the function of which can be seen in later figures. In this embodiment, the hinge 122 is a feature of the second zipper strip 104, though a hinge may reside on the first zipper strip, or on both zipper strips. As can be seen in the figures, the hinge is a bridge of material that separates the reclosure profile of one zipper strip from the remainder of the strip, at or near the top end of the strip. For example, in FIG. 1 the hinge separates the protrusions and grooves and closure tab of the second zipper strip from the knurled region and lower flange of the second zipper strip, where the hinge is a bridge of material that may rotate about a point at or near the top end of the second zipper strip.

The reclosure profile of the zipper assembly of this disclosure includes complementary zipper strip engagement components on each zipper strip 102, 104. Though the child resistant features of this disclosure embrace a wide variety of zipper strip engagement mechanisms and structures, a series of embodiments are seen in the figures. Returning to FIG. 1, each zipper strip 102, 104 includes a pair of protrusions 124 and a pair of grooves 126, where the protrusions and grooves are complementary in shape and provide a substantially airtight seal along the length of the zipper strip. In this embodiment, the protrusions 124 of each strip include complementary hook surfaces that meet at a hook closure region 128 to provide a snug closure and improved seal over many conventional reclosure mechanisms.

In the embodiment of FIG. 1, the uppermost groove 126 of the second zipper strip 104 is defined by the space between second closure tab 120 and an adjacent protrusion 124. Adjacent protrusions form the lower groove of the second zipper strip. Alternatively, the lowermost groove of the first zipper strip 102 is defined by the space between a lower protrusion 130 and an adjacent protrusion 124, where a lower protrusion may not necessarily include a hook surface.

The child resistant nature of the zipper assembly 100 can be seen, in part, where the first closure tab 118 and the second closure tab 120 meet at the opening point 116. This opening point does not provide any easy gripping flanges or tabs to permit the pulling apart of the two zipper strips 102, 104.

While a common feature of reclosable zipper assemblies of the prior art is a flange above the reclosure profile of each zipper strip, distal from the lower flanges, the zipper assembly of this disclosure does not include any such upper flanges. The lack of such upper flanges prevents the relatively easy opening of the zipper assembly, aiding in its child-resistant nature. To open the zipper of this disclosure, a consumer would make use of the texturized gripping regions 106. These regions facilitate opening the zipper, where a user may grip one side of the zipper with the forefinger and the other side of the zipper with the thumb, thereby pinching the zipper assembly, in a finger placement analogous to that which might be used to close a zipper by sliding one's fingers in unison along the length of a zipper assembly. However, to open the zipper of the present disclosure, once the finger and thumb are in place as described above, one may perform a "snapping" or opposing direction finger motion, thereby causing the zipper tracks to slide linearly in relation to one another in opposite directions. This action causes a slight separation of the closed alignment of the zipper assembly such that a small gap may be made in the zipper opening point 116 to allow the user to grasp the opposing zipper strips 102, 104 at their closure tabs 118, 120 and pull the zipper open, granting the user access to the interior of the bag 114.

Although the figures show the texturized gripping regions residing on the zipper strips, at or near the reclosure profiles, on the outer sides of the strips, the texturized gripping regions may reside further down the zipper assembly, as low as the lower flanges 112 or perhaps even lower. In an embodiment, the texturized gripping regions may reside on the upper end of the bag walls 110, such that the aforementioned finger placement and opening mechanism may be initiated by snapping or opposingly moving fingers on the texturized regions of the bag walls.

Figure 2:
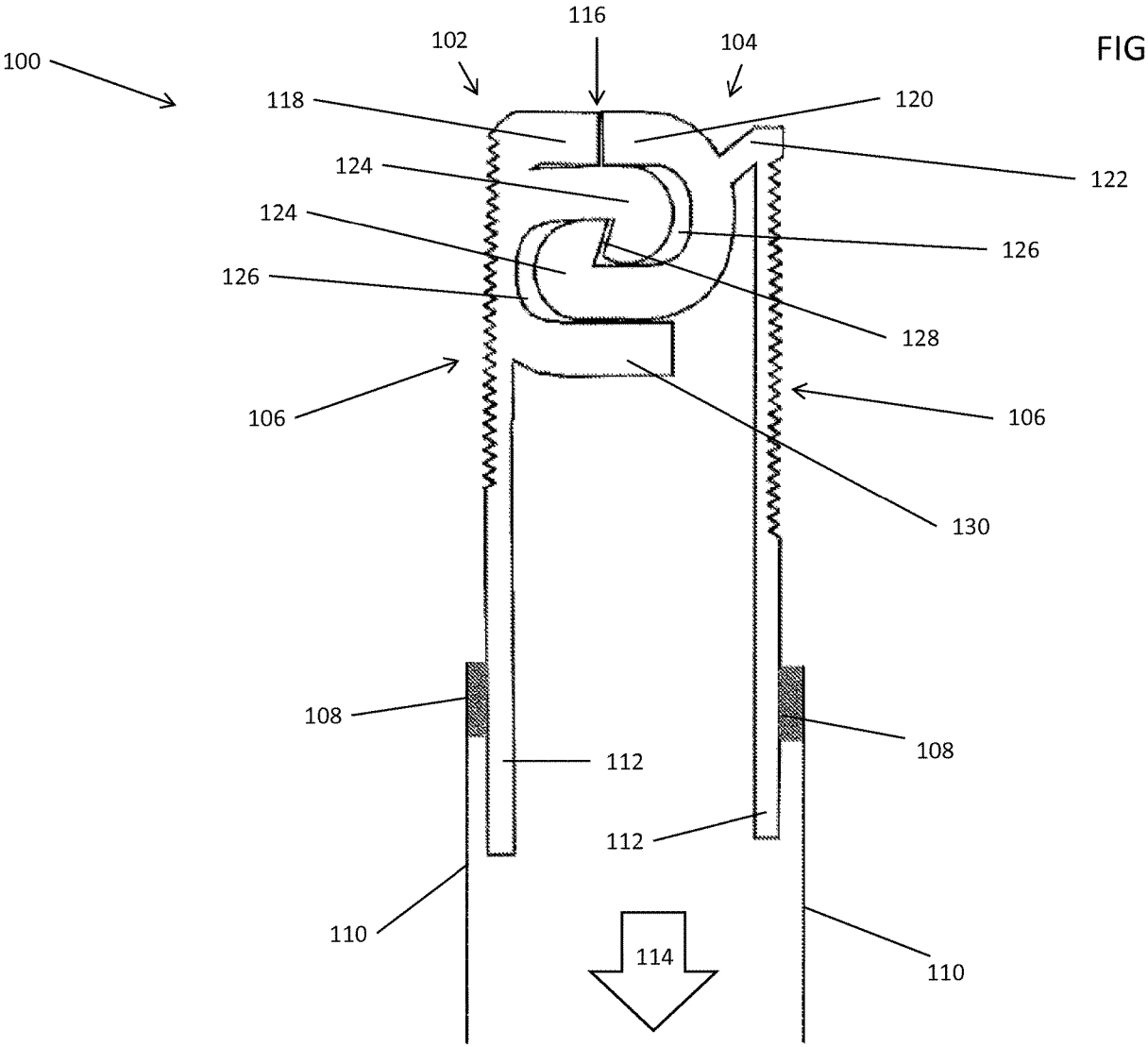
FIG. 2 shows a profile view of a second embodiment of a zipper of the disclosure, this particular zipper having a hinged zipper feature, the zipper having been affixed to a pouch.

FIG. 2 shows a profile view of a second embodiment of the reclosable zipper assembly of the disclosure. In this embodiment, each of the first zipper strip 102 and second zipper strip 104 includes only one groove 126. The groove 126 of the first zipper strip 102 is defined by a protrusion 124 and a lower protrusion 130, whereas the groove 126 of the second zipper strip 104 is defined by a protrusion 124 and the second closure tab 120. In this embodiment, the grooves 126 and protrusions 124 are complementary in shape and meet at a hook closure region 128 to provide an enhanced seal. This embodiment includes an optional hinge 122 feature, this hinge present on the second zipper strip 104.

Figure 3:
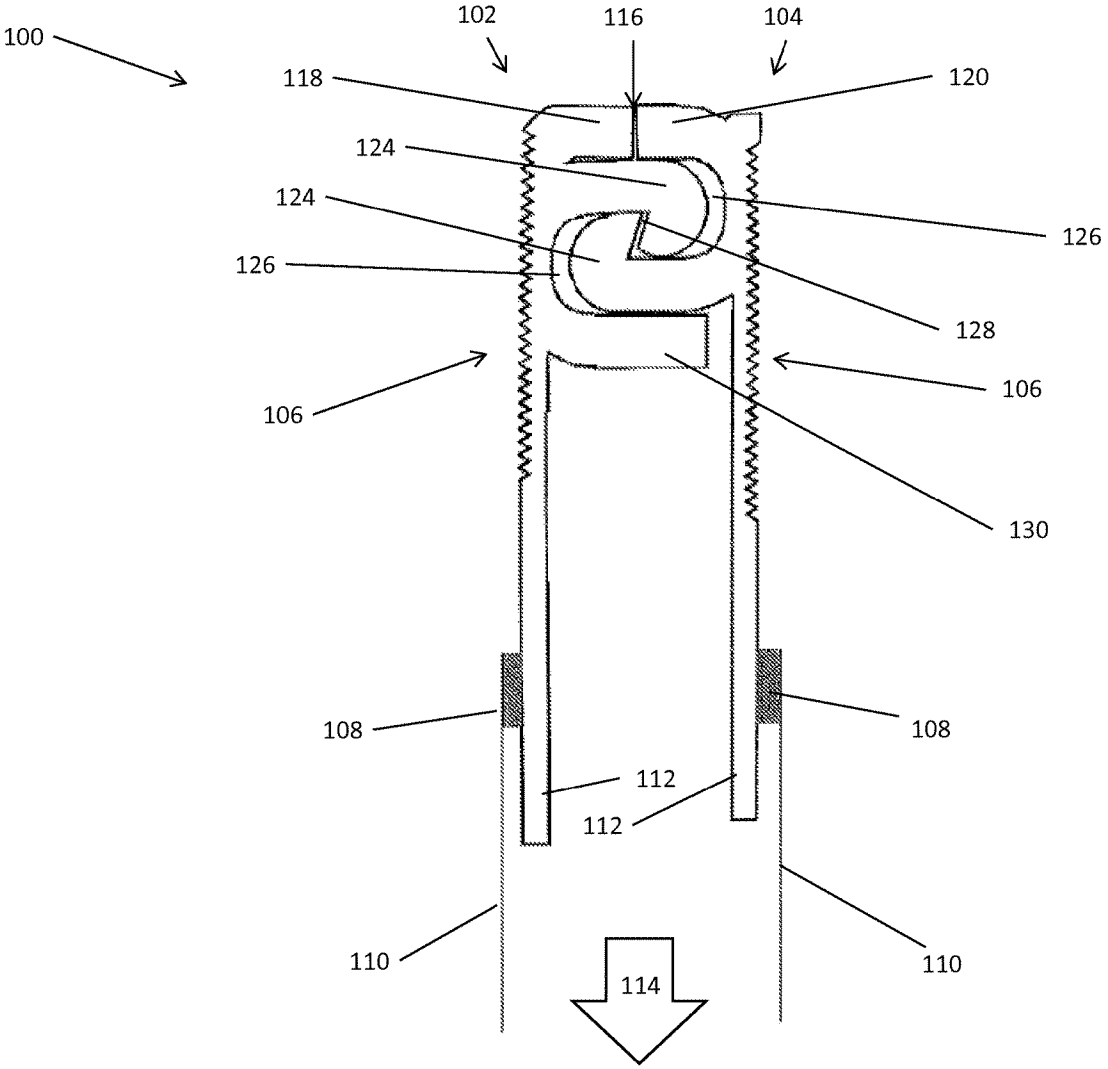
FIG. 3 shows a profile view of a third embodiment of a zipper of the disclosure, the zipper having been affixed to a pouch.

FIG. 3, viewed in comparison to FIG. 2, is distinguished in that in this third embodiment no optional hinge is present. The reclosure profile of the second zipper strip 104 is integral with the texturized gripping region 106, analogous to the arrangement on the first zipper strip 102.

Figure 4:
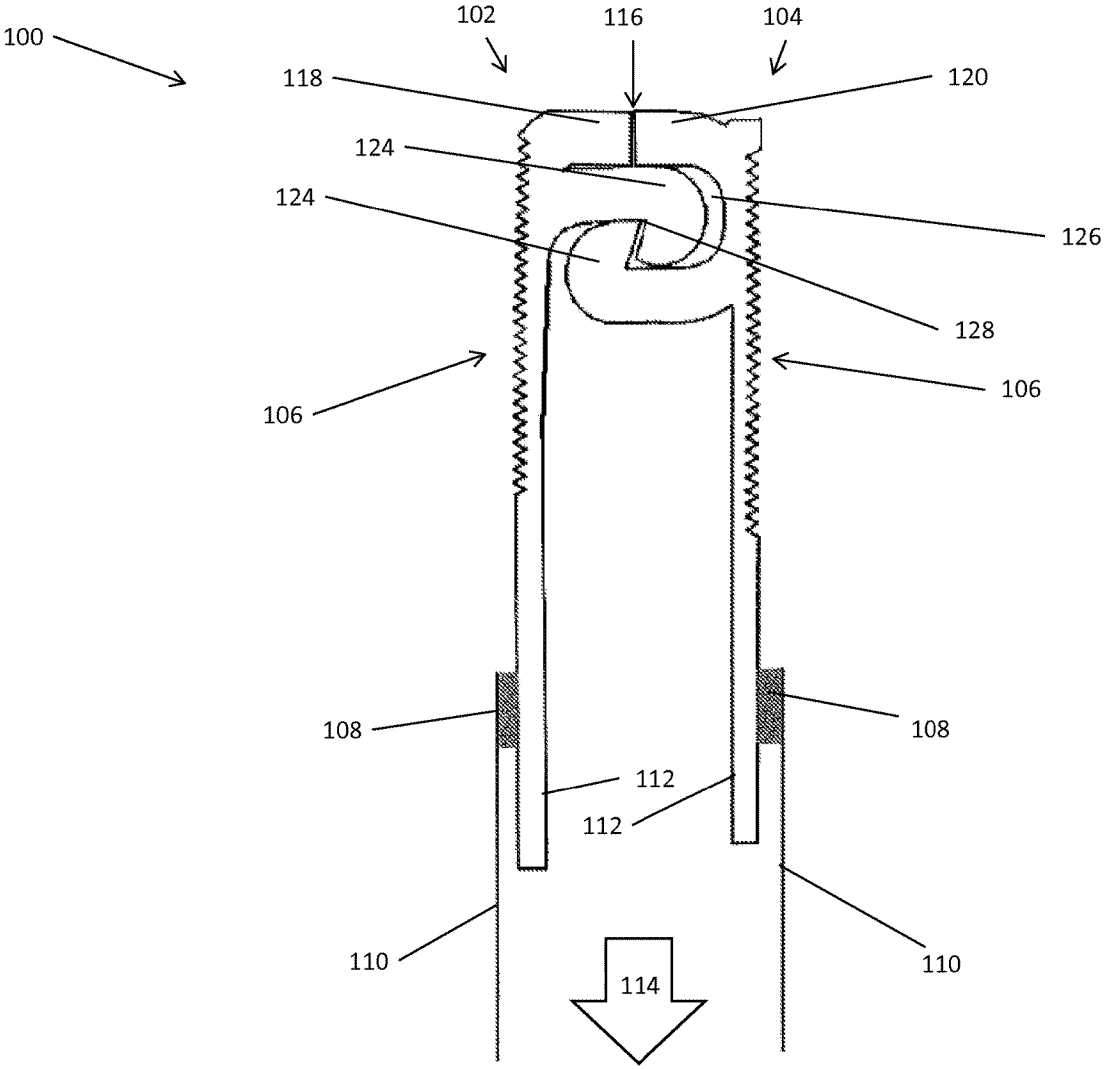
FIG. 4 shows a profile view of a fourth embodiment of a zipper of the disclosure, the zipper having been affixed to a pouch.

FIG. 4, viewed in comparison to FIG. 3, is distinguished in that in this fourth embodiment no lower protrusion 130 is present. In this way, only one groove 126 is present, residing on the second zipper strip 104 and defined by the protrusion 124 thereon and the second closure tab 120. This lone groove 126 is complementary in shape to the protrusion 124 of the first zipper strip 102. These protrusions include complementary hook surfaces that meet at a hook closure region 128 to provide a snug closure.

Figure 5:
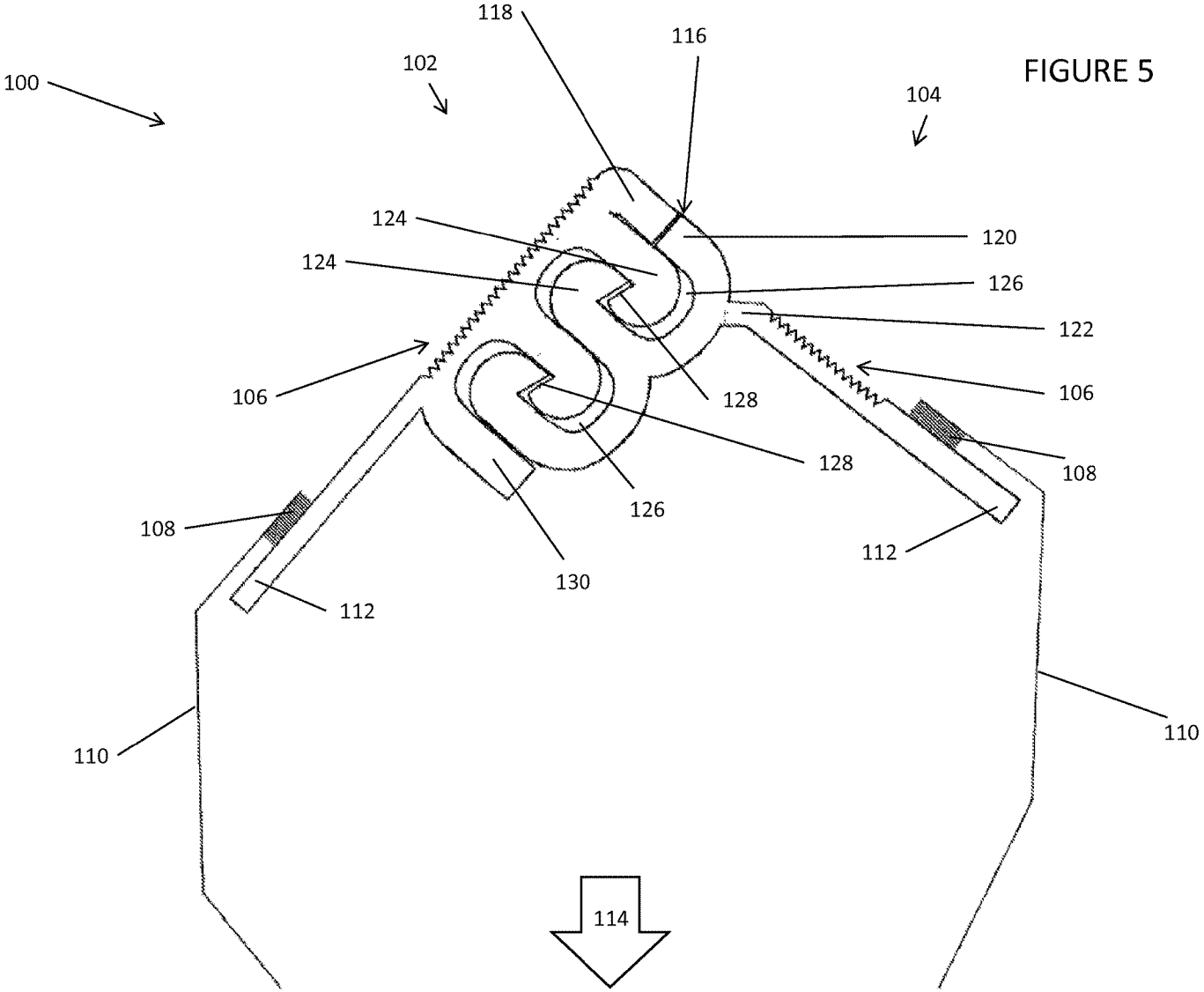
FIG. 5 shows a profile view of the embodiment of the zipper of FIG. 1, this figure detailing an optional hinged zipper feature in function during an attempt to open the pouch from below the zipper assembly.

FIG. 5 demonstrates, via a profile view of the embodiment of FIG. 1, the benefits of the optional hinge 122 feature on a zipper assembly 100. In this instance, a user has attempted to open the pouch by pulling on the side walls 110 of the container to gain access to the contents 114. The outward forces of the pulling on the side walls, however, do not cause any pulling apart of the complementary zippers 102, 104, which remain snugly engaged. Instead, the texturized gripping region 106 and flanges 112 of the second zipper strip 104 rotate away from the remainder of the zipper assembly, thereby preventing the opening of the container. While the hinge 122 is an optional feature, its presence may improve the child resistant nature of a reclosable zipper assembly of the disclosure.

Figure 6:
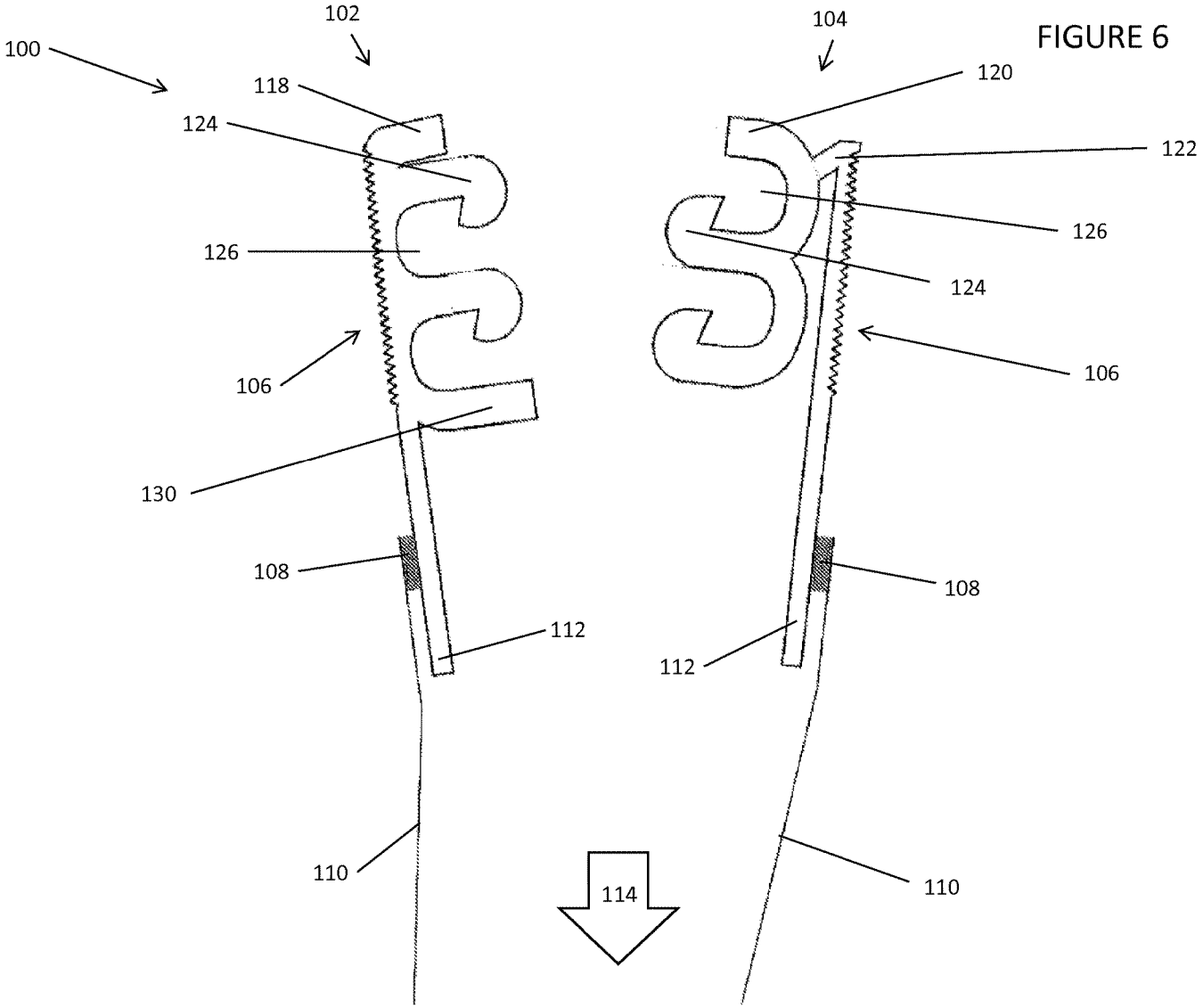
FIG. 6 shows a profile view of the embodiment of the zipper of FIG. 1, this figure showing the pouch having been opened via the successful disengagement of the two complementary sides of the resealable zipper assembly.

FIG. 6 shows the embodiment of FIG. 1, the zipper assembly 100 having been opened, granting a user access to the interior 114 of the bag onto which the zipper has been mounted.

Though not seen in the figures, a crimp seal or other mechanism for terminating and sealing off the ends of the zipper assembly may be present at each distal end of a segment of the reclosable plastic zipper assembly of indefinite length. When present, such a termination may extend downwardly through the lower flanges of each zipper strip such that the termination and heat seal in combination provide a substantially complete seal between the interior of the bag and the outside environment.

Thus, as can be seen from the foregoing description the figures, a reclosable plastic zipper assembly of indefinite length is disclosed, the assembly having a first zipper strip and a second zipper strip, each zipper strip having an upper end and an exterior surface, where the first zipper strip further includes at its upper end a first closure tab, and the second zipper strip further includes at its upper end a second closure tab. The first zipper strip includes at least one protrusion and the second zipper strip includes at least one protrusion, where the second closure tab and the at least one protrusion of the second zipper strip define a recess, the recess being complementary in shape to the at least one protrusion of the first zipper strip such that the zipper strips may be mated by inserting the at least one protrusion of the first zipper strip into the recess along the along the length of the plastic zipper strip to create a closure of the zipper assembly. In this way, the first closure tab and the second closure tab meet at an opening point when the strips have been mated to provide the closure. The zipper strips each further include a texturized gripping region on their exterior surfaces.

The disclosure additionally includes a bag having a reclosable plastic zipper assembly of the disclosure mounted thereon. In such an embodiment, the texturized region may be on the zipper assembly, as seen in the figures, or the upper ends of the bag side walls, where the plastic zipper assembly is affixed to the bag, may include a texturized gripping region.

Although the figures show only the upper side walls 110 of the bag, it should be understood that the zipper assembly 100 of this disclosure is intended to be mounted on a complete bag, or at least on a product that will at some point become a complete bag. The side walls 110 of the figures may be viewed as continuing down to a sealed bottom or an open bottom that may be sealed.

As seen in the figures, an optional hinge 122 feature is disclosed. This hinged feature, while shown in the figures, when present, as a component of the second zipper strip 104, should not be so limited. The hinge 122 may appear as a component of the first zipper strip 102, depending on the application of the zipper and the desires of the manufacturer.

It should be understood that the profile views seen in the figures are representative of the length of the zipper assembly. Where the zipper assembly has been cut into segments, it may be desirable in some applications for a heat seal, for example in the form of a crimp or a pinch, to be present on the distal lateral ends of the zipper strips such that when the zipper assembly has been opened, the distal ends of the zipper assembly remain sealed and joined.

Though the figures show the zipper strips adhered or affixed via a heat seal 108 to bag or pouch walls 110 in the upper end of the bag or pouch via the attachment being on lower flanges 112 of each zipper strip, the lower flanges may be affixed to the upper bag walls by placing the flanges outside the bag walls, whereby the zipper assembly essentially caps the bag opening. The mechanism of attachment of the zipper assembly to the bag and the spatial relationship of the lower flanges to the upper walls should not be construed as limited to only the mechanism and spatial relationship seen in the figures. A multitude of mechanisms are embraced by this disclosure, as long as the zipper assembly provides access through the opened zipper to the inner contents of the bag or pouch, while providing an effective child resistant seal while the zipper is closed.

In an embodiment, a continuous spool of the zipper 100 of the disclosure is integrated into an in-line bag manufacturing machine. An example of such a machine is one where rolled plastic film is folded, sealed, and cut into bags. Those bags may have the zipper attached to the bag via heat seal or hot melt adhesive or other conventional zipper-to-bag attachment processes. The resulting product is a bag having the disclosed zipper assembly attached thereon, as can be seen in the various figures.

In an embodiment, the geometry and arrangement of the various protrusions and grooves, including any hooks thereon when present, may be substantially congruent to one another. In an embodiment, this congruency provides a substantially airtight and/or watertight seal along the length of the zipper.

A variety of reclosure profiles may be used in conjunction with the disclosed child resistant zipper assembly, including but not limited to those seen in U.S. Pat. No. 7,914,208 and/or U.S. Pat. No. 6,954,969, both assigned to Com-Pac International, Inc., the assignee of the present application. The entireties of U.S. Pat. Nos. 7,914,208 and 6,954,969 are hereby incorporated by reference.

Possible applications for a zipper of the disclosure include the attachment of the zipper to a package having contents unsuitable for children (such as medication or toxic substances, for example). Other uses include maintaining a child resistant seal for bags that contain tobacco or *cannabis*.

The terms reclosable and resealable are used interchangeably herein. It would be understood by those of skill in the art that, as used herein, these terms generally refer to zipper assemblies that may be opened and closed repeatedly to form a substantially complete seal across the length of the zipper assembly.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention as well as all equivalents thereof.

I claim:

1. A reclosable plastic zipper assembly of manufacturer definable length comprising a first zipper strip having an upper end, an inner surface, an exterior surface, a lower flange, and a first reclosure profile having an upper end and a lower end defining a plurality of protrusions and at least one recess defined between two of the protrusions, with at least one protrusion having a first hook surface and at least one recess having a first hook mating cavity shape, the first reclosure profile including an end protrusion defining a first closure tab defining a first upper zipper strip surface at the upper end of the first zipper strip, the first zipper strip not having any portion extending beyond the first closure tab, the first closure tab having a non-mating end, a second zipper strip having an upper end, an inner surface, an exterior surface, a lower flange, and a second reclosure profile having an upper end and a lower end defining a plurality of protrusions and at least one recess defined between two adjacent protrusions, with at least one protrusion having a second hook surface that is congruent with the first hook mating cavity shape and at least one recess having a second hook mating cavity shape that is congruent with the first hook surface of the at least one first zipper strip protrusion, the second reclosure profile being complementary to the first reclosure profile for selectively mating therewith, the second reclosure profile including an end protrusion defining a second closure tab defining a second upper zipper strip surface at the upper end of the second zipper strip, the second zipper strip not having any portion extending beyond the second closure tab, the second closure tab not having a second non-mating end, the second closure tab and the at least one protrusion with the hook surface of the second zipper strip define a top second zipper recess there between, the top second zipper recess being substantially congruent in shape to the at least one protrusion with the hook surface of the first zipper strip such that the zipper strips may be mated by inserting the at least one protrusion of the first zipper strip into the top second recess along the length of the plastic zipper strip to create a closure of the zipper assembly, the second upper end defined by the second closure tab being aligned with the first upper end defined by the first closure tab of the first zipper strip and defining a closed opening point between the two non-mating ends thereof when the second zipper strip is mated with the first zipper strip, and wherein the first upper zipper strip surface and the second first upper zipper strip surface are substantially aligned and define an aligned top end of the assembly with no portion of the assembly and no other portion of either the first zipper strip and the second zipper strip extending above the two upper ends defining the opening point when mated, and the first and second zipper strips each including a texturized gripping region on the respective exterior surfaces opposite the first and second reclosure profiles, respectively, the texturized regions formed on the exterior surfaces extend from the upper ends of the first and second zipper strips downward to a position at or below the lower ends of both the first and second reclosure profiles of the first and second zipper strips; wherein at least one zipper strip further comprises a hinge, where a hinge is a bridge of plastic material that separates the reclosure profile including the protrusions, the at least one recess, and the closure tab of the zipper strip from the associated texturized gripping region of that zipper strip, the hinge being positioned at or near the upper end of the that zipper strip.

2. The zipper assembly of claim 1, wherein the second zipper strip defines at least one recess by the second closure tab and at least one lower protrusion of the second zipper.

3. The zipper assembly of claim 2, wherein each zipper strip further comprises a plurality of contiguous interleaved recesses and protrusions, where each recess and protrusion of the first zipper strip has a hook shape that is complementary in shape to the hook shape recesses and protrusions of the second zipper strip such that the zipper strips may be mated to create a closure of the zipper assembly.

4. The zipper assembly of claim 1, wherein the second zipper strip defines at least one recess by the second closure tab and at least one lower protrusion of the second zipper strip.

5. The zipper assembly of claim 4, wherein each zipper strip further comprises a plurality of contiguous interleaved recesses and protrusions, where each recess and protrusion of the first zipper strip has a hook shape that is complementary in shape to the hook shape recesses and protrusions of the second zipper strip such that the zipper strips may be mated to create a closure of the zipper assembly.

6. The zipper assembly of claim 1 wherein the texturized regions on the exterior surfaces of the first and second zipper strips is a knurled texture.

7. The zipper assembly of claim 1 wherein the texturized regions formed on the exterior surfaces are continuous from the upper ends of the first and second zipper strips downward to a position at or below the lower ends of both the first and second reclosure profiles of the first and second zipper strips.

8. The zipper assembly of claim 1 wherein the texturized region on the second zipper strip extends downward below the texturized region on the first zipper strip.

9. The zipper assembly of claim 1 wherein at least one of the first and second reclosure profiles is integral with the texturized region of the same zipper strip.

10. The zipper assembly of claim 9 wherein the texturized regions of the first and second zipper strips each extends downward and beyond the reclosure profiles.

11. The zipper assembly of claim 1 wherein the non-mating end of the first closure tab and the non-mating end of the second closure tab are each shaped to have a flat tab end and wherein each are dimensioned to define the walls of the closed opening point when the first and second zipper strips are mated.

12. The zipper assembly of claim 1 wherein the first reclosure profile and the second reclosure profiles are each configured to slide linearly in relation to each other in response to a received opposing force as applied by the fingers of a user to the first and second texturized regions, and configured to create to a slight separation of the first closure tab from the second closure tab defining a gap in closed opening point.

13. The zipper assembly of claim 1 wherein the texturized regions on the exterior surfaces of the first and second zipper strips are is a knurled texture.

14. The zipper assembly of claim 1 wherein the texturized regions formed on the exterior surfaces are continuous from the upper ends of the first and second zipper strips downward to a position at or below the lower ends of both the first and second reclosure profiles of the first and second zipper strips.

15. The zipper assembly of claim 1 wherein the texturized region on the second zipper strip extends downward below the texturized region on the first zipper strip.

16. The zipper assembly of claim 1 wherein the second zipper strip includes the hinge and the first zipper strip does not include the hinge, and wherein the first reclosure profile is integral with the texturized region of the first zipper strip.

17. A method of operating the zipper assembly of claim 1 for providing reclosable access to a bag assembly to which the zipper assembly is attached, the method comprising pressing the first zipper strip and the second zipper strip together to mate the first reclosure profile with the second reclosure profile and to abut the first closure tab to the second closure tab to define the aligned closed opening point on the top end of the assembly; and applying a first user finger force to the first texturized region and applying a second user finger force to the second texturized region that is in the opposing direction to the first user finger force;

creating a slight gap in the top end of the closed opening point; and grasping at least one of the first closure tab and the second closure tab at the created slight gap and pulling the first zipper strip away from the second zipper strip to un-mate the first reclosure profile from the second reclosure profile.

18. A reclosable bag comprising a plastic zipper assembly affixed to the bag to provide reclosable access to the interior of the bag, the plastic zipper assembly comprising the elements of claim 1.

* * * * *